US008181675B2

(12) United States Patent
Combrink

(10) Patent No.: US 8,181,675 B2
(45) Date of Patent: May 22, 2012

(54) METHOD AND DEVICE FOR FILLING A CONTAINER

(75) Inventor: Alois Combrink, Oelde (DE)

(73) Assignee: Haver & Boecker OHG, Oelde (DE)

( * ) Notice: Subject to any disclaimer, the term of this patent is extended or adjusted under 35 U.S.C. 154(b) by 471 days.

(21) Appl. No.: 12/516,502

(22) PCT Filed: Nov. 26, 2007

(86) PCT No.: PCT/EP2007/010252

§ 371 (c)(1),
(2), (4) Date: Jul. 8, 2009

(87) PCT Pub. No.: WO2008/064847

PCT Pub. Date: Jun. 5, 2008

(65) Prior Publication Data

US 2010/0089490 A1 Apr. 15, 2010

(30) Foreign Application Priority Data

Dec. 2, 2006 (DE) ..... 10 2006 057 176

(51) Int. Cl.
*B65B 3/04* (2006.01)

(52) U.S. Cl. ..... 141/10; 141/83; 141/315; 53/526

(58) Field of Classification Search ..... 141/10, 141/68, 83, 94–96, 114, 313, 314, 317; 53/526
See application file for complete search history.

(56) References Cited

U.S. PATENT DOCUMENTS 2,886,072 A 5/1959 Hoff
3,533,454 A 10/1970 Tinsley
4,492,535 A * 1/1985 Stahlkopf ..... 417/394

FOREIGN PATENT DOCUMENTS

DE 3703714 A1 8/1988
DE 19541975 A1 5/1997

* cited by examiner

*Primary Examiner* — Gregory Huson
*Assistant Examiner* — Jason Niesz
(74) *Attorney, Agent, or Firm* — Pearne & Gordon LLP

(57) ABSTRACT

Method and apparatus for filling bags with loose materials, wherein a package to be filled is filled by means of a filling element through a filling process. The filling process comprises a filling stage, a settling stage, and a discharge stage wherein during the filling stage, loose material is filled into the bag while admitting air and in the settling stage, a settling phase is provided for the pressure to drop and in the discharge stage, the bag is discharged from the filling element. The filling process is shortened in that the available volume of the bag is reduced during the filling process to maintain the pressure prevailing in the bag high, while at the end of the filling process the available volume of the bag is expanded to rapidly reduce the pressure prevailing in the bag.

16 Claims, 3 Drawing Sheets

METHOD AND DEVICE FOR FILLING A CONTAINER

Figure 1:
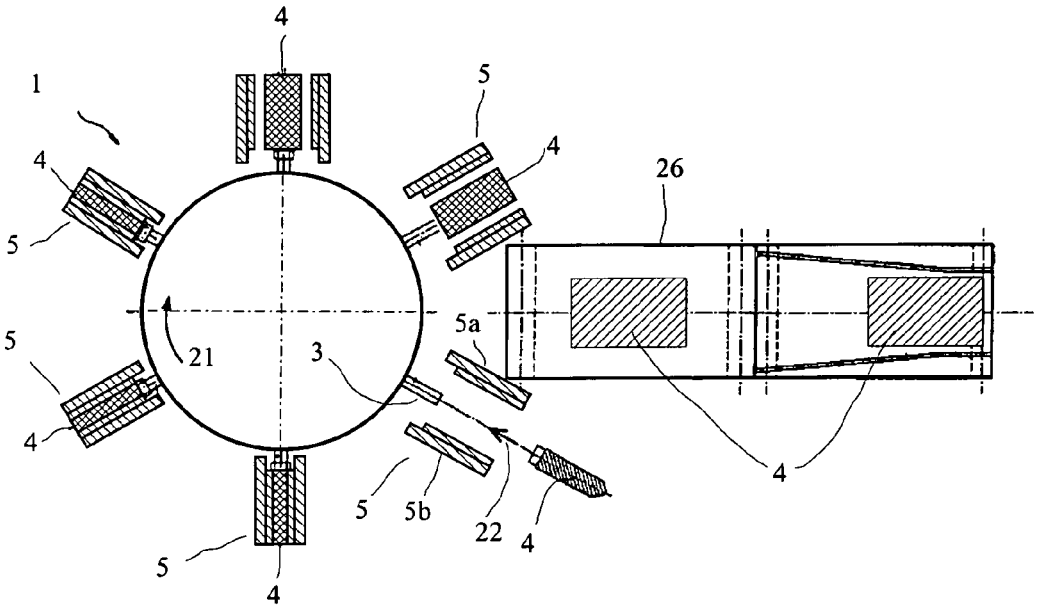

The present invention relates to a method and an apparatus for filling a flexible package or container, in particular a bag, with loose materials and in particular with bulk goods, wherein the flexible package is filled by means of a filling element. The invention serves to bag powdered or granular products and in particular to bag lightweight and very fine, powdered products such as aerosils, and carbon black particles employed in paint manufacture or $TiO_2$ particles or $TiO_2$-containing materials or the like where the bulk goods contain a considerable amount of air during bagging. The invention is furthermore suitable for bagging other kinds of loose or free-flowing bulk materials or for bagging toxic or environmentally hazardous products.

Different systems for bagging bulk materials have become known in the prior art. In conventional systems for filling loose bulk goods into valved bags, the bulk goods include a certain air content during filling. The air content in the bag is allowed to gradually escape to the exterior through corresponding vents in the bag wall.

Still, excess pressure is present in the bag during the filling process, for example approximately 150 to 250 millibars. Such excess pressure is still present as the filling element is cut off. Now when the bag is pulled off the filling element at the moment of cutting off, the pressure in the bag is abruptly released through the valve, which is still open, so as to release from the bag to the exterior a certain quantity of material which in particular in the case of lightweight materials can be substantial. This will cause loss of bag weight and also contamination of the system and the bags. When bagging for example carbon black particles or $TiO_2$ particles, small quantities of escaped goods will already cause quite considerable contamination in the ambience.

To reduce material escape and to improve the cleanliness of the installation and the bags, the prior art therefore provides that discharge of the bag is deferred until the pressure in the bag interior has decreased through the wall, or else the excess pressure needs to be released through a bypass. Pressure decrease through the walls in particular in the case of lightweight materials is very time-consuming such that a dramatic reduction of the bagging capacity must be expected. While releasing the pressure through a bypass accelerates the pressure decrease, material is not prevented from also escaping through the bypass which then results in weight loss of the bags. This may lead to substantial weight fluctuations. Also, escaped material must as a rule be discarded. On the whole, this condition will increase operating costs.

In the prior art, U.S. Pat. No. 3,533,454 has disclosed an apparatus for filling materials into bags. During the filling operation the side faces of the bag are initially crushed in. During filling the side walls are then allowed to expand such that the filling material will not clog the pores in the side walls of the bag already during the filling operation. In this way continuous venting is intended to be provided during filling. Such continuous venting may increase the filling rate during bagging. This known method will only relatively slightly reduce the entire filling process because said process is significantly determined by the maximum pressure in the bag at the end of filling and the subsequent waiting time after filling is terminated. Since the maximum pressure remains unchanged, the waiting time remains unchanged and the filling process is only shortened very slightly.

In the prior art there was further disclosed in DE 195 41 975 A1, a method and an apparatus for forming and venting open bags after filling wherein the top edges of the bag wall overhangs are slidingly clamped in jaws and wherein after filling the clamping jaws are rolled in the direction of the bag filling level so as to allow the retained air to escape from the bag by means of a lance inserted in the bag through the upper feed inlet on which a vacuum can be applied. In this way the waiting time can be effectively reduced. One disadvantage of the known apparatus is, however, that the lance introduced into the bag does not only allow air but also filled material to escape.

DE 37 03 714 A1 discloses a bagging machine for bagging powdered goods with a filling spout which filling spout is provided with an air outlet equipped with a filter and connected with a vacuum source to draw the air out of the bag by suction. This apparatus may be used for filling powdered materials into valved bags. It is a disadvantage of the known apparatus, however, that when employing a coarse-pored filter, considerable quantities of filling material still escape through the outlet while when employing a fine-pored filter, the pores clog up rapidly and thus considerably reduce effectiveness.

These apparatuses known from the prior art must thus, wherever material can escape from the bag with the air, provide for the bags to be overfilled by the expected amount of weight loss to reduce or compensate for weight fluctuations of the filled bags. Since such weight losses vary, weights will inevitably be largely scattered such that, in order to comply with minimum weights, more material must as a rule be bagged than is in fact required. Alternatively the settling time after the end of the filling operation may be extended for the excess pressure to decrease.

In all of the cases described there is a disadvantage to the method shown by a noticeable cost increase, clearly reduced capacities, and/or loss of materials.

In view of the indicated prior art the object of the present invention is therefore to provide a method and an apparatus which allow a rapid filling of flexible packages while at discharge there is only slight or even virtually no loss of weight.

This object is solved by a method having the features of claim 1. The apparatus according to the invention is the object of claim 16. Preferred specific embodiments of the invention are the subjects of the subclaims. Further advantages and characteristics can be taken from the embodiment.

The method according to the invention is provided for filling flexible packages with loose materials and it serves preferably for filling bags in particular with lightweight loose materials. The package to be filled is filled through a filling element or through multiple filling elements by means of a filling process. The filling process comprises at least a filling stage, a settling stage, and a discharge stage. At the end of the filling process, the volume of the package and in particular the volume available to the package is expanded according to the invention so as to reduce the pressure prevailing in the package.

During the filling stage at least one type of loose material is filled into the package in particular while admitting air. In the settling stage at least one settling phase is provided for the pressure to decrease and in the discharge stage the package is discharged from the filling element. Optionally the bag may be sealed. According to the invention the filling process is also shortened by way of reducing the available volume of the package during a substantial part of the filling process to maintain a high pressure in the package during filling. At the end of the filling process, the available volume of the package is expanded so as to rapidly reduce the pressure in the package.

The term "filling process" in the sense of the present application is understood to mean the process from placement or disposing of the package until discharge or removal of the filled package. The filling process comprises in particular, presenting or placing the package, the actual filling operation of the package, and discharge of the filled package.

The term "filling operation" is understood to mean the process of filling, i.e. the filling stage. The term "during the filling process" in the sense of the present application is understood to mean that the volume is reduced in respect of time after starting the filling process, i.e. after presenting or placement and before discharge of the package.

A further significant advantage of the invention is the volume expansion at the end of the filling process to thereby greatly reduce the excess pressure. The expansion of the volume available to the package causes the pressure prevailing in the package to decrease directly proportionally to the volume expansion, so as to achieve a direct pressure reduction by way of the volume expansion since due to the increased internal pressure, the flexible package will immediately assume the expanded volume. Consequently the discharge pressure can be achieved rapidly such that no large material losses will occur as the packages are discharged since the internal pressure of the package is reduced due to the expansion of volume.

Another advantage of the method according to the invention is an improved bag venting occurring already during the filling operation. Basically a bag will start venting when excess internal pressure is present, i.e. when a pressure difference relative to the ambience is present. This moment typically occurs from approximately 50% of the weight to be bagged. Due to the fact that in the method according to the invention the volume first available to the package is reduced, the pressure level in the bag will rise more steeply during the filling operation than in conventional methods so as to achieve an excess pressure in the bag at a considerably earlier time so as to set off spontaneous venting of the bag. Since the venting rate of the package depends on the pressure difference between the bag interior and the ambience, the high excess pressure level prevailing during the filling stage will provide optimal venting. Venting of the package will be considerably accelerated.

When the pressure prevailing in the bag is plotted over time, the area beneath the curve represents a measure of the venting work. This surface area, being related to the duration of actual filling, is increased in the method according to the invention such that the invention can achieve more rapid filling.

First experiences in a specific case have shown that excess pressure is building up in about half the time required otherwise, such that even during filling, effective venting occurs over a clearly longer period of time.

According to the invention the volume is increased near the end of the filling process, in particular at the end of the filling stage or in the settling stage after the filling operation is terminated, while the package is still placed on the filling spout or the filling element. For example if the volume available to the flexible package is increased directly after cutting off the filling element, this means a directly proportional reduction of the internal pressure in the package such that the package can either be discharged directly or at least the required waiting time is quite considerably reduced. In a specific case, the duration of the settling phase was reduced from ca. 20 seconds to 5 seconds while the duration of the filling stage remained constant at approximately 30 seconds, such that the duration of the filling process was reduced by 20 to 30%.

Preferably the available volume is maintained substantially constant during the filling stage. During the filling stage, a specified pressure is advantageously rapidly built up in the package and subsequently roughly maintained. The built-up pressure may be the maximum possible pressure or a pressure specified in view of keeping within safety margins.

The available volume may be expanded in the settling stage only after a settling phase to advance venting.

All of the configurations and embodiments preferably provide for the squeezing jaws to be pressure-controlled.

In a preferred specific embodiment the contact pressure of the squeezing jaws in the settling phase is first increased for a time after the filling stage is terminated before the available volume is subsequently increased by means of decreasing the contact pressure of the squeezing jaws. In this way, venting is further increased at the increased pressure level so as to still further shorten the settling stage.

A more specific embodiment of the invention provides for capturing during the filling process, in particular during filling or during the filling operation, in periodic intervals or continuously, a characteristic for the weight of the package or the feed material contained in the package. The weight may be determined by way of a net-weight or particularly preferably a gross-weight method. It is also possible for a bag chair on which the package is placed to be part of the weighing system. Since the weights of the parts involved are known, one can deduce the actual weight of the feed materials contained in the package from the measured total weight.

As a package reaches its target weight, the material feed is preferably cut off. Also it is possible to employ weight-related control of the filling operation or the filling process wherein, as a predetermined weight or weight proportion is attained, the filling rate is reduced from the coarse filling rate to the slow filling rate. Or else, as a predetermined weight or weight proportion is attained, the filling rate may be continuously reduced down to a minimal filling rate to achieve optimal filling.

A preferred embodiment of the invention provides that as a predetermined weight or weight proportion is attained, the volume available to the package is expanded. Volume expansion may in particular occur abruptly or approximately abruptly. In all of the configurations the available volume in the settling stage may be greatly expanded within a short time, e.g. in one step or abruptly. What is also possible is a continuous volume expansion after the filling stage is terminated.

In this embodiment as well as in all of the other embodiments the volume available to the package can firstly be restricted preferably by side boundaries, squeezing devices, squeezing jaws or the like, which squeezing jaws or the like may then be displaced outwardly at the end of the filling process and in particular in the settling stage to expand the available volume of the package. In preferred embodiments the boundary devices or squeezing jaws or the like may act on the longitudinal package sides.

For example the squeezing device may firstly confine the volume available to the package such that it is smaller than the possible package volume. In the settling phase the squeezing devices or the like can then be removed or displaced from the package such that the package expands due to the prevailing internal pressure to thereby reduce the internal pressure in the package accordingly. Expansion of the volume available to the package may occur abruptly or continuously or incrementally.

In preferred embodiments of the invention the volume available to the package is expanded up to 50% or more, in particular up to 30%. Preferably the volume expansion is between approximately 3% and 20% and particularly preferably between approximately 5% and 15%. Depending on the material to be bagged the percentage may be still larger for particularly fluffy and lightweight materials.

Where, near the end of the filling phase, the excess pressure in the bag is e.g. 100 millibars, the internal pressure will be approximately 1.1 bars. Expanding the volume by 10% allows to approximately entirely dissipate the excess pressure in the bag. In the case of high excess pressures, even a volume expansion of 10% allows to achieve a nearly complete pressure decrease if after cutting off the filling element a short waiting time is observed within which the pressure decreases automatically to a certain extent through the vents in the bag. According to the invention both the waiting time and the settling stage can be shortened considerably.

It is preferred that after cutting off the filling element, the waiting time is first observed and then the volume is expanded since the pressure decrease in the preceding time period occurs more rapidly with higher excess pressures.

In all of the embodiments of the invention, a characteristic for the filling pressure in the package may be captured preferably by means of a pressure sensor. What is determined is in particular a characteristic for the air pressure prevailing in the package.

For example, a filling element configured as a filling pipe or a filling spout may be provided with a probe having a measuring channel which reaches into the interior of the package to be filled such that a sensor connected with the measuring channel captures a characteristic for the pressure prevailing in the package. Other embodiments may provide for a characteristic for the pressure prevailing in the package to be deduced by means of a sensor connected with the filling element or with the package.

Advantageously the entire filling process or at least the filling operation is controlled in dependence on the characteristic determined. This allows to maintain threshold values in the filling operation. Preferably the filling process is controlled such that a specified maximum pressure is not exceeded to avoid e.g. bag rupture. On the other hand the filling element is preferably controlled such that the pressure present in the package or in the bag is as close as possible to the maximum pressure to accelerate the entire filling process.

Preferred specific embodiments of the invention provide that at least during a time period the volume available to the package varies in dependence on the characteristic determined for the filling pressure prevailing in the package.

In case that a pressure sensor is provided for determining a characteristic for the filling pressure prevailing in the package, the time of discharging the package from the filling element or the filling spout is preferably selected in dependence on the filling pressure to limit the quantity of filled product escaping at discharge.

All of the embodiments in particular provide for the filling of valved bags which are closed after filling or else may be configured self-sealing.

All of the embodiments preferably employ a diaphragm pump for conveying the loose materials. Although diaphragm pumps are basically machines for conveying fluids, this system has also been tried and tested for conveying loose materials and in particular lightweight loose materials.

The functional principle of diaphragm pumps is similar to that of piston pumps wherein diaphragm pumps provide a complete separation of the bulk material to be filled from the drive. Separation is achieved by means of a diaphragm through which the moving, mechanical components of the motor are shielded from any interaction with the bulk material to be conveyed.

The actual mechanical drive of the diaphragm pump may be conventional by means of an electric motor through a con-rod fastened to the diaphragm or by way of appropriately controlled compressed air.

Diaphragm pumps offer the advantage over conveyor turbines that their filling capacities are less dependent on the excess pressure prevailing in the bag, such that the increased pressures prevailing during the filling operation have little impact on the quantities conveyed.

Preferably, twin diaphragm pumps are employed which may be pneumatically controlled. To this end, a twin housing is provided comprising a pair of diaphragms connected through a connecting rod. The external surfaces of the diaphragms are exposed to the bulk material to be conveyed and the internal surfaces, to compressed air. By way of the connecting rod, a valve is actuated which, as a final position is reached, directs the compressed air towards the other diaphragm. Such an air-controlled diaphragm pump transmits the air pressure directly to the bulk material to be conveyed. Throttling the pressure allows to readily adjust the quantity of the conveyed bulk material.

All of the embodiments are provided for bagging in particular lightweight bulk materials at a density below 300 kg per $m^3$ or at a density below 300 g per $dm^3$. What is preferably bagged is bulk material at a density beneath 250 kg per $m^3$ and in particular of a density between 30 and 150 kg per $m^3$.

The apparatus according to the invention for filling flexible packages is in particular provided for filling bags with loose materials, comprising at least one filling element by means of which a package to be filled is filled by way of a filling process in particular while admitting air. The filling process comprises at least a filling stage, a settling stage for pressure decrease, and a discharge stage. Therein, a squeezing device or a confinement device is provided by means of which the volume provided for the package can be varied. Furthermore a control device is provided which is suitable and structured to shorten the filling process in that by means of the squeezing or confinement device, the volume available to the package is reduced during a considerable part of the filling process and at the end of the filling stage it is greatly expanded, so as to maintain a high pressure inside the package during the filling stage and to shorten the settling stage following the filling stage.

The apparatus according to the invention, which is in particular suitable for performing one of the methods described above, may in particular be used for efficiently filling valved bags wherein the volume expansion after the filling stage allows efficiency in filling the bags.

Advantageously, squeezing jaws are employed as components of the squeezing device to act on the package from the sides.

Advantageously, a pressure sensor is provided to determine a characteristic or a characteristic for the pressure prevailing in the package.

Preferably the apparatus comprises a comparator device to compare the pressure prevailing in the package against a specified pressure or a threshold level so as to emit a discharge signal at the end of the filling process when the pressure prevailing in the package is below or equal to the specified pressure.

Advantageously the apparatus comprises a diaphragm or twin diaphragm pump for conveying the bulk materials.

Further advantages and applications of the invention follow from the embodiments which will now be described with reference to the attached figures.

Figure 2:
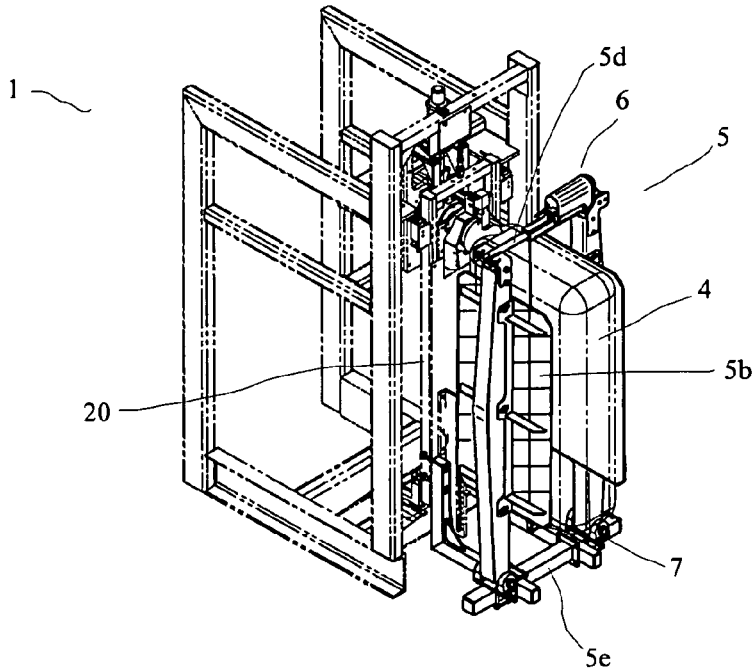
Figure 3:
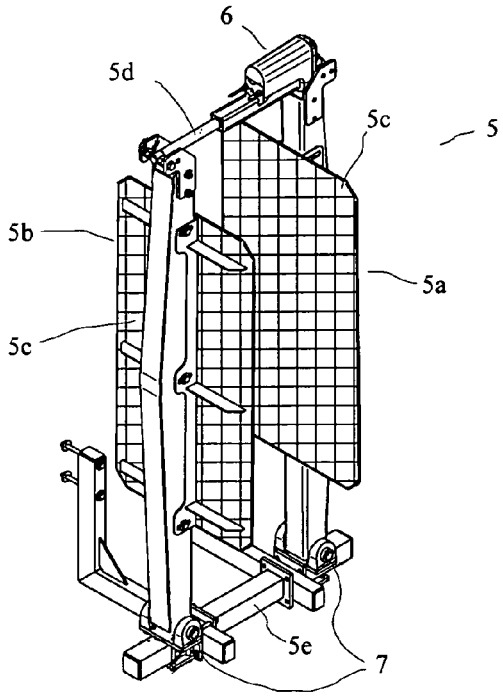
Figure 4:
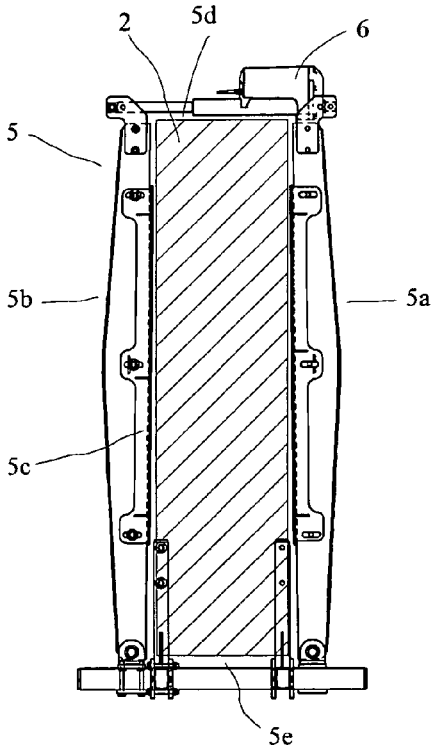
Figure 5:
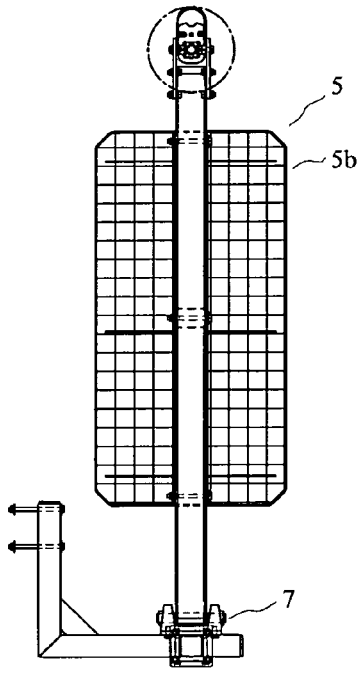
Figure 6:
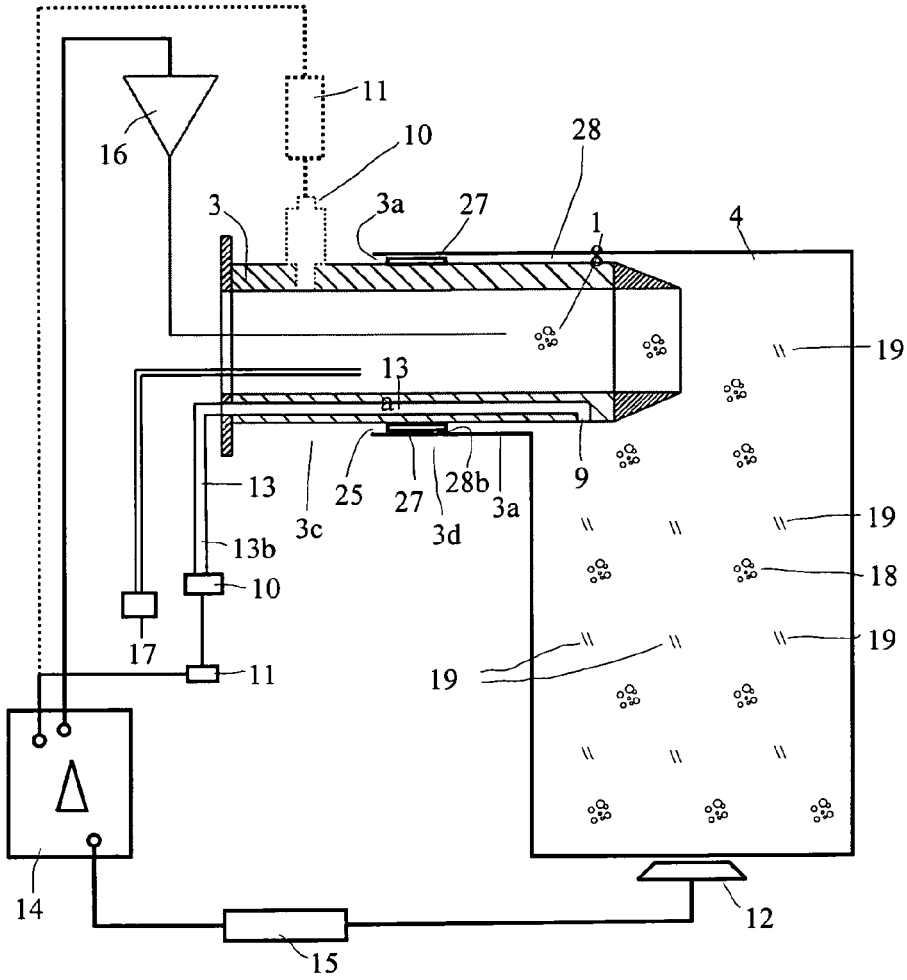
Figure 7:
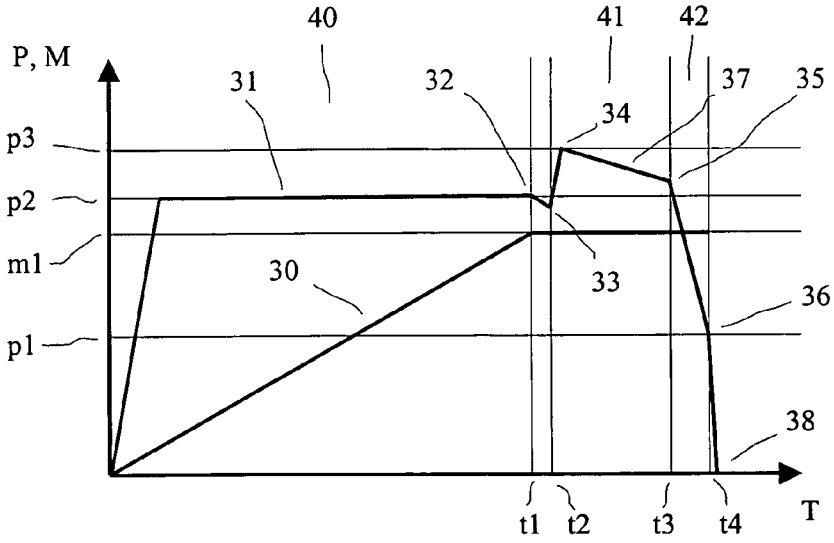

These show in:

FIG. 1 a schematic illustration of an apparatus according to the invention;

FIG. 2 a perspective view of another apparatus according to the invention;

FIG. 3 a perspective view of the squeezing device according to FIG. 2;

FIG. 4 a front view of the squeezing device according to FIG. 3;

FIG. 5 a side view of the squeezing device according to FIG. 3;

FIG. 6 a schematic sectional view of a filling pipe of an apparatus according to the invention; and FIG. 7 a simplistic illustration of the pressure and the weight over time during a filling process.

With reference to the FIGS. 1 to 7, an embodiment of the invention will now be described. The inventive apparatus 1 illustrated in FIG. 1 is configured in the present exemplary embodiment as a rotary packaging machine which can be driven in the direction of arrow 21. The packaging machine 1 serves to fill bags 4 with loose filling materials 18, being configured fully automatic in the present embodiment.

The packaging machine 1 comprises six filling pipes 3 onto which the valved bags 4 having openings 25 are placed. As the arrow 22 in FIG. 1 signifies, the valved bags 4 arriving from a storage are taken by way of a placement apparatus—not shown—or by hand and pushed or shot onto the filling pipes 3.

The valved bags 4 are filled during one or more rotations and as the pre-specified filling level is reached they are discharged in a pre-defined angular position. The valves of the valved bags 4 are closed and the bags are thrown onto the discharging belt 26 where the actually reached weight of the valved bags 4 may be checked once more before the valved bags 4 are carried off.

As illustrated in FIG. 1, each filling pipe 3 is provided with a squeezing apparatus 5 associated therewith and comprising pairs of squeezing jaws 5*a* and 5*b*. For placement, the squeezing jaws 5*a* and 5*b* are moved apart such that the valved bag 4 can readily be pushed onto the filling pipe 3. Thereafter the squeezing jaws 5*a* and 5*b* are displaced to approach the valved bag from the sides such that the volume 2 available to the valved bag (see FIG. 4) is reduced from the start of the filling process, being smaller than the possible bag volume of the valved bag 4.

During rotation of the valved bag 4 the bag with the feed material 18 is filled during the filling stage 40 until the intended bag weight m1 is reached. A very simplistic course, plotted in principle only, of the bag weight 30 and the pressure 31 prevailing in the bag is illustrated over the time T in FIG. 7. During the filling stage 40 an excess pressure has been building up in the valved bag 4 of typically up to 100 or 250 millibars and which may be larger still, depending on the feed material and the other conditions present. The bag 4 inflates as much as possible due to the excess pressure, assuming the maximum available volume which, however, is initially confined by means of the squeezing jaws 5*a* and 5*b*.

The filling operation is cut off at the time t1 as the intended bag weight m1 is reached. Following a short settling time during which the internal bag pressure slowly decreases, the pressure can be increased at the time t2 by means of the squeezing jaws 5*a* and 5*b*. The pressure in the bag thereby increases from pressure 33 to pressure 34, subsequently descending along the curve 37 since the increased internal pressure causes the venting of the bag to accelerate.

At the time t3 the squeezing jaws 5*a* and 5*b* are opened at the pressure 35, so as to abruptly expand the volume available to the valved bag 4 between the squeezing jaws 5*a* and 5*b*. The valved bag 4 now assumes its maximum volume due to the excess pressure prevailing in the interior of the valved bag 4 whereby the pressure prevailing in the interior of the valved bag 4 is correspondingly reduced. The present result is that directly as the squeezing jaws 5*a* and 5*b* open up, the internal bag pressure 36 equals the discharge pressure p1, such that the bag can be discharged at the time t4. After discharge any excess pressure possibly remaining abruptly drops to thus attain the ambient pressure as illustrated by the point 38.

In this way the settling stage 41 can be considerably shortened. The additional increase of pressure to the value p3 may, although it does not need to, be performed.

Unlike the illustration in FIG. 7, the filling stage 40 tends to be subdivided into a phase of coarse filling and a subsequent phase of fine filling. For reasons of clarity this is not shown in FIG. 7.

Due to the filling process, the waiting time required before the valved bag 4 can be discharged from the filling pipe 3 is considerably reduced such that the filling speed is higher than in conventional filling processes. At the same time, the amount of material escaping from the filling pipe 3 at discharge decreases because the internal pressure is reduced such that contamination of the valved bags 4, the packaging machine 1 and the surroundings is reduced.

The inventive packaging machine 1 is preferably employed for bagging lightweight materials and in particular aerosils, carbon black, and other lightweight products. Or else it is conceivable to bag other products such as cement or the like by means of the inventive packaging machine 1.

Experiences with bagging lightweight filling materials such as pyrogenic silicic acid, have thus far revealed a noticeably increased output while at the same time improving weight accuracy. While in conventional machines the waiting time after terminating the filling operation until excess pressure in the bag has decreased, used to be between approximately 15 and 20 seconds for a given feed material, the inventive system allows to discharge the bag soon after or even immediately as the volume available to the bag has expanded. Time saving in this example amounts to about 12 to 17 seconds per bag. Given an average duration of the filling operation of about 30 seconds, this means that the filling process will come down from 50 seconds to approximately 35 seconds, thus achieving a quite considerable increase of the system capacity of approximately 20 or 30 to 40%. In the case of heavier materials or materials admitting less air in bagging, the increase in output may be smaller.

FIG. 2 illustrates a perspective view of another packaging machine 1 according to the invention which is presently configured as a stationary machine but not as a rotary system. The bag chair 20 is part of the weighed system in the so-called gross weighing method wherein weighing includes the bag chair 20 and the squeezing device 5 and the valved bag 4 to be filled, to thus derive the quantity of the feed material 18 in the valved bag 4 from the determined weight (see FIG. 6), since the weights of the bag chair and the other involved components are known.

The squeezing device 5 comprises a right squeezing jaw 5*a* and a left squeezing jaw 5*b* which in the initial position are disposed e.g. approximately in parallel and spaced apart and whose lower ends in the present case are pivotally supported on pivot axes 7. The two squeezing jaws 5*a* and 5*b* are interconnected at their top ends by way of a top bar linkage 5*d*, on which a motor 6 is disposed. Actuating the motor 6 causes the upper distance between the squeezing jaws 5*a* and 5*b* to be reduced so as to act on the volume 2 present between the squeezing jaws 5*a* and 5*b*, as can in particular be seen in the illustration of FIG. 4. Alternatively, instead of the motor 6, a different actuator for actuating the squeezing jaws may be provided which may comprise e.g. a compressed-air cylinder or a hydraulic drive.

Instead of the rotatable mounts at the bottom ends of the squeezing jaws 5*a* and 5*b*, which are provided with a squeezing plate 5*c* each, the bottom linkage 5*e* may be configured to be adjustable in length by means of a motor 6 or another kind of actuator.

By means of a length-adjustable linkage system 5*d* and 5*e*, a parallel displacement of the squeezing jaws 5*a* and 5*b* can be achieved.

According to the invention the squeezing jaws 5*a* and 5*b* of the bag chair 20 are approached to the valved bag 4 at the start of the filling process or the filling operation such that they reduce the available bag volume 2 during filling by e.g. 10%. This means that, given a weight magnitude of e.g. 10 kg, only a reduced volume will be available. Now, as the valved bag has obtained its target weight and the filling operation is thus terminated, the valved bag 4 will firstly be under a typical excess pressure of e.g. 100 or 250 millibars or the like. At this moment the two squeezing jaws on the sides are moved apart such that the volume available to the valved bag 4 quasi abruptly expands, thus compensating the excess pressure.

Therefore the valved bag 4 can be discharged as the squeezing jaws 5*a* and 5*b* have been moved apart without incurring a detrimental material loss at discharge. Consequently this system allows increased bagging capacity since while no or only a minimum waiting period after filling is required, no feed material 18 or only negligible amounts will escape at discharge.

In preferred embodiments the packaging machine comprises a twin diaphragm pump for conveying the feed material 18. A twin diaphragm pump 16 is particularly suitable for bagging lightweight feed materials 18. The filling capacity in the case of feed materials at a bulk weight beneath 100 g per $dm^3$ is approximately 60 bags per hour and filling spout, although it may be above or beneath said value.

Reference is made at this point that according to the invention not only rotary packaging machines 1 may be provided but there may be employed, packaging machines 1 having one filling pipe only or multiple filling pipes in series.

The filling process provides for the filling operation to be controlled by means of weighing control which controls the filling rate in dependence on the filled weight already present in the valved bag 4. Often a larger material stream, the so-called coarse stream, is first bagged until a predetermined weight proportion is reached. Subsequently, filling is continued by way of the so-called fine stream at a clearly reduced material stream until the intended target weight m1 of the valved bag 4 is reached.

An advantageous configuration of the invention will now be described with reference to the FIG. 6. FIG. 6 illustrates a schematic cross-section through a filling pipe 3. Differently from the preceding embodiment the packaging machine 1 in FIG. 6 has at least one additional pressure sensor 10 provided at the filling pipe 3 by means of which a characteristic for the pressure prevailing in the valved bag 4 can be captured.

FIG. 6 is a sectional view of a filling pipe 3 onto which a valved bag 4 is pushed by way of its opening 25. The valved bag 4 is retained and sealed against the ambience by means of a swelling collar 27 attached to an external surface 3*a* of the filling pipe 3. When swollen, the swelling collar 27 bears against an internal wall 28*b* of a portion 28 of the valved bag 4 which serves to attach the valved bag 4 to the filling pipe 3.

By means of the squeezing device according to the FIGS. 3 to 5 the volume 2 available to the valved bag 4 is already reduced before the filling stage is started.

Furthermore, during the filling process the pressure sensor 10 captures a value characteristic of the pressure in the valved bag 4. Said pressure sensor 10 may be disposed in an area 3*c* of the filling pipe 3 immediately adjacent to an area 3*d* covered by the portion 28 of the valved bag 4. The pressure sensor 10 penetrates a wall of the filling pipe 3 to thus capture the pressure in the interior of the filling pipe 3 which substantially corresponds to the pressure prevailing in the valved bag.

Alternatively, a pressure sensor 10 may be provided to capture the pressure prevailing in the interior of the bag by means of a pressure sensing aperture 9 or a measuring channel or a measuring line 13. The pressure sensing aperture 9 may e.g. be provided in a forwardly region of the filling pipe 3 adjacent to the outlet opening for the feed material 18. The measuring line 13 may comprise a first portion 13*a* in the filling pipe configured as a channel and a second portion 13*b* configured as a flexible or rigid line and connected with the pressure sensor 10. Since pressure disorders spread at sonic speed, the measuring line 13 may have a considerable length.

The pressure data captured by the pressure sensor 10 are put in intermediate storage in the associated digital evaluation unit 11 and transmitted to a central control unit 14. The filling process is controlled by way of the data measured by means of the weighing system 12 and by means of the pressure sensor 10. The measured values measured by the weighing device 12 are transmitted to an electronic processing unit 15 which is connected with the central control unit 14 which in turn controls the conveyor element 16.

For specific materials or in particular situations, air may be fed through an air supply 17 to loosen e.g. caked layers.

The filling process operates as follows. After placing a valved bag 4 on a filling pipe 3 by hand or by means of an automatic placement unit, the valved bag 4 is retained by means of the swelling collar 27, and the squeezing jaws 5*a* and 5*b* are approached to the bag to restrict the volume available to said bag. Thereafter the filling operation is started, controlled by the electronic control unit 14 and wherein the feed material 18 and a quantity of air 19 are introduced into the bag 4 at the same time.

The feed material 18 fed to the conveyor element 16 from a storage bunker or the like, is introduced into the valved bag 4 through the filling pipe 3. The quantity of the filling material 18 is continuously captured by the weighing device 12, which is shown only schematically, and the measured values are transmitted to the processing unit 15 and the control unit 14.

The pressure prevailing in the valved bag 4 is captured at the same time. When the internal pressure in the valved bag exceeds a predetermined threshold, the filling operation is decelerated to keep the valved bag 4 from rupturing. Reversely, the filling rate may be increased if the pressure prevailing in the valved bag is beneath a predetermined pressure.

The positions of the squeezing jaws are controlled in dependence on the current weight and the pressure as determined in the valved bag 4. It is e.g. conceivable for the squeezing jaws 5*a* and 5*b* to reduce the volume available to the bag only as a predetermined percentage of e.g. 30 or 50% of the target filling volume has been filled into the bag. Or else it is conceivable that after termination of the filling operation the squeezing jaws 5*a* and 5*b* are continuously moved apart to continuously expand the volume available to the bag.

The squeezing jaws are preferably moved apart from one another after the filling operation is terminated such that the pressure in the bag interior drops abruptly. Now when the excess pressure determined in the bag interior falls beneath a predetermined or selectable value, the bag is discharged. Since no or only a slight excess pressure is present at discharge, only very little or no feed material 18 is blown out of the bag at discharge, such that the bags 4 and the packaging machine 1 remain cleaner.

The invention claimed is:

1. A method for filling flexible packages (4), in particular for filling bags (4), with loose materials (18), wherein by means of a filling element (3) a package to be filled (4) is filled by way of a filling process, which filling process comprises at least a filling stage (40), a settling stage (41) and a discharge stage (42), wherein during the filling stage (40) at least one loose material (18) is filled into the package (4) and wherein during the settling stage (41) at least one settling phase (37) is provided for pressure decrease, and wherein during the discharge stage (42) the package is discharged from the filling element (3), characterized in that the filling process is shortened in that the available volume (2) of the package (4) is reduced during a considerable portion of the filling process, so as to keep the pressure inside the package (4) high, while at the end of the filling process, the available volume (2) of the package is expanded (4) to rapidly reduce the pressure prevailing in the package (4).

2. The method according to claim 1, wherein the volume (2) is maintained substantially constant during the filling stage (40).

3. The method according to claim 1 wherein during the filling stage (40) a specified pressure (p2) is rapidly built up in the package and subsequently roughly maintained.

4. The method according to claim 1 wherein the volume (2) in the settling stage (41) is expanded following a settling phase (37).

5. The method according to claim 1 wherein the volume (2) in the settling stage (41) is greatly expanded in one step.

6. The method according to claim 1 wherein a characteristic for the weight of the package (4) is captured during the filling stage (40) and as the target weight (m1) of the package (4) is attained, feeding of the material (18) is cut off.

7. The method according to claim 1 wherein the available volume (2) is expanded up to 30%.

8. The method according to claim 1, wherein the available volume (2) is influenced by means of lateral squeezing jaws (5*a*, 5*b*) acting on the longitudinal sides of the package (4), which are displaced outwardly for expanding the available volume (2).

9. The method according to claim 8, wherein the squeezing jaws (5*a*, 5*b*) are pressure-controlled.

10. The method according to claim 8, wherein the contact pressure of the squeezing jaws (5*a*, 5*b*) is first increased in the settling phase (41) after the filling stage is terminated (40) before the available volume is expanded by means of decreasing the contact pressure of the squeezing jaws (5*a*, 5*b*).

11. The method according to claim 1, wherein a pressure sensor (10) captures a characteristic for the filling pressure (31) in the package (4) and the filling process is controlled in dependence on the filling pressure (31).

12. The method according to claim 1 wherein the volume (2) is varied at least during a time period (40, 41) in dependence on the filling pressure (31).

13. The method according to claim 1, wherein the discharge time (t3) is selected in dependence on the filling pressure (31).

14. The method according to claim 1, wherein a diaphragm pump (16) is employed for conveying the loose materials (18).

15. The method according to claim 1, wherein the loose materials (18) have a low density and in the filling stage (40) during filling, a high air content.

16. The method according to claim 1 wherein the available volume (2) is expanded between 5% and 15%.

* * * * *